US008570121B2

(12) United States Patent
Sawada et al.

(10) Patent No.: US 8,570,121 B2
(45) Date of Patent: Oct. 29, 2013

(54) AIR CIRCUIT BREAKER

(75) Inventors: Masashi Sawada, Hitachi (JP); Ayumu Morita, Hitachi (JP); Masato Yabu, Hitachi (JP); Motoki Shibuya, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 13/204,759

(22) Filed: Aug. 8, 2011

(65) Prior Publication Data

US 2012/0038438 A1 Feb. 16, 2012

(30) Foreign Application Priority Data

Aug. 12, 2010 (JP) ..... 2010-180976

(51) Int. Cl.
*H01H 77/00* (2006.01)

(52) U.S. Cl.
USPC ..... 335/6; 335/220

(58) Field of Classification Search
USPC ..... 335/6
See application file for complete search history.

(56) References Cited

U.S. PATENT DOCUMENTS

| | | | | |
|---|---|---|---|---|
| 7,623,010 | B2 * | 11/2009 | Liu | 335/6 |
| 7,911,303 | B2 * | 3/2011 | Morita et al. | 335/174 |
| 2006/0028073 | A1 * | 2/2006 | Sugino et al. | 310/49 R |
| 2007/0007249 | A1 * | 1/2007 | Kikuchi et al. | 218/128 |
| 2008/0156775 | A1 | 7/2008 | Morita et al. | |

FOREIGN PATENT DOCUMENTS

| | | |
|---|---|---|
| EP | 1 416 503 | 5/2004 |
| EP | 1 739 701 | 1/2007 |
| EP | 2 187 416 | 5/2010 |
| JP | 2003-308762 | 10/2003 |
| JP | 2006-59823 | 3/2006 |
| JP | 2007-73829 | 3/2007 |
| JP | 2008-159270 | 7/2008 |
| JP | 2010-44927 | 2/2010 |
| WO | WO 99/33078 | 7/1999 |

OTHER PUBLICATIONS

Extended European Search Report issued in European Application No. 11177326.3 dated Jul. 19, 2012.
Office Action issued in Japanese Patent Application No. 2010-180976 on Oct. 23, 2012.
Office Action issued in Japanese Patent Application No. 2010-180976 on Mar. 19, 2013.

* cited by examiner

*Primary Examiner* — Elvin G Enad
*Assistant Examiner* — Lisa Homza
(74) *Attorney, Agent, or Firm* — Antonelli, Terry, Stout & Kraus, LLP.

(57) ABSTRACT

An air circuit breaker comprises: a make-and-break unit having a stator and a blade-shaped movable element rotatably supported with a support shaft; an electromagnetic operation unit having a fixed iron core, a movable iron core provided below the fixed iron core, a coil to produce an electromagnetic force, and a permanent magnet; a capacitor to store electric power to excite the coil; a control circuit board that controls a carrying direction of a current supplied from the capacitor to the coil in response to an input command or a breaking command to the make-and-break unit; and a servo mechanism provided above the electromagnetic operation unit and connected to the movable iron core, that transmits a driving force from the electromagnetic operation unit to the make-and-break unit.

6 Claims, 2 Drawing Sheets

AIR CIRCUIT BREAKER

CLAIM OF PRIORITY

The present application claims priority from Japanese Patent application serial no. 2010-180976, filed on Aug. 12, 2010, the content of which is hereby incorporated by reference into this application.

TECHNICAL FIELD

The present invention relates to an air circuit breaker, and more particularly, to an electromagnetic actuated air circuit breaker.

BACKGROUND ART

Generally, an air circuit breaker has a make-and-break contact unit having a structure for input/breaking by rotating a blade-shaped movable contact with respect to a fixed collector, an arc-extinguishing device to extend an arc length upon breaking for current limiting, an input operation electromagnet to drive the make-and-break contact unit via a link mechanism, and a tripping device which operates in accordance with a breaking command.

As this type of air circuit breaker, known is an air circuit breaker provided with a blade-shaped movable contact, a first lever mechanism connected to the movable contact, an input operation electromagnet, and a second lever mechanism connected to an end of a plunger of the electromagnet via a connection member, a roller rotatably provided at the end of the second lever mechanism is in contact with a force application point to operate the first lever. In this structure, it is possible to suppress increase of strokes of the input operation electromagnet thus downsize the electromagnet (see e.g. Patent Literature 1).

CITATION LIST

Patent Literature

[Patent Literature 1] Japanese Patent Laid-open No. 2010-44927

SUMMARY OF INVENTION

Technical Problem

In the air circuit breaker in the above-described Patent Literature 1, in the first lever mechanism connected to the movable contact, as the arm length of the force application point can be shortened, the increase of the strokes of the input operation electromagnet can be suppressed. As a result, the electromagnet can be downsized.

However, in the air circuit breaker in the above-described Patent Literature 1, since the plunger of the electromagnet is moved upward against the gravitational force, upsizing cannot be avoided so as to ensure the breaking speed, and the downsizing of the electromagnet is limited. Further, the number of parts is increased in the above-described Patent Literature 1 because two lever mechanisms associated with each other is used as a so-called servo mechanism.

On the other hand, there are further downsizing and price down requirements from consumers.

The present invention has been made in view of the above problems and an object of the present invention is to provide a further-downsized and price-reduced air circuit breaker without enlarging and complicating the electromagnet and servo mechanism as an operation unit for the make-and-break unit.

Solution to Problem

According to one aspect of the present invention, the above object is attained by providing an air circuit breaker comprising: a make-and-break unit having a stator (a fixed element) and a blade-shaped movable element disposed oppositely to the stator and rotatably supported with a support shaft; an electromagnetic operation unit having a fixed iron core provided in an upper position, a movable iron core provided in a lower position oppositely to the fixed iron core, a coil to connect/disconnect the fixed iron core and the movable iron core with an electromagnetic force, and a permanent magnet; a capacitor that energy-stores electric power to excite the coil of the electromagnetic operation unit; a control circuit board that controls a carrying direction of a current supplied from the capacitor to the coil in response to an input command or a breaking command to the make-and-break unit; and a servo mechanism connected to the movable iron core in the electromagnetic operation unit and provided above the electromagnetic operation unit so as to transmit a driving force by the electromagnetic force of the electromagnetic operation unit to the make-and-break unit.

Further, in the air circuit breaker, the permanent magnet of the electromagnetic operation unit is provided under a support plate of the coil so as to be in contact with a lower part of the movable iron core when the movable iron core is brought into contact with the fixed iron core.

Further, in the air circuit breaker, the movable elements are independently formed for three phases, and the servo mechanism has insulating rods connected to the respective movable elements, levers with their one ends connected via connecting pins to the respective insulating rods, a rotation shaft that pivotally supports through the other ends of the respective levers, and a connecting member connecting a movable iron core of the electromagnetic operation unit to at least one of the levers.

Further, in the air circuit breaker further comprising a breaking spring with one end attached to the connecting pin of the servo mechanism and the other end attached to a bottom plate of the air circuit breaker, the breaking spring is extended and energy-stored when the movable element in the make-and-break unit is inputted and the connecting pin is pulled upward.

Further, in the air circuit breaker, the electromagnetic operation unit is provided approximately at the center in a frontal view widthwise direction of the air circuit breaker.

Advantageous Effects of Invention

According to the present invention, as an air circuit breaker operation mechanism is formed by combining a simple servo mechanism and an electromagnetic operation unit with a permanent magnet, the electromagnetic operation unit can be downsized, and a sufficient breaking speed can be ensured. As a result, further downsized and price-reduced air circuit breaker can be provided.

DESCRIPTION OF EMBODIMENTS

Hereinbelow, an embodiment of an air circuit breaker of the present invention will be described with reference to the drawings.

Figure 1:
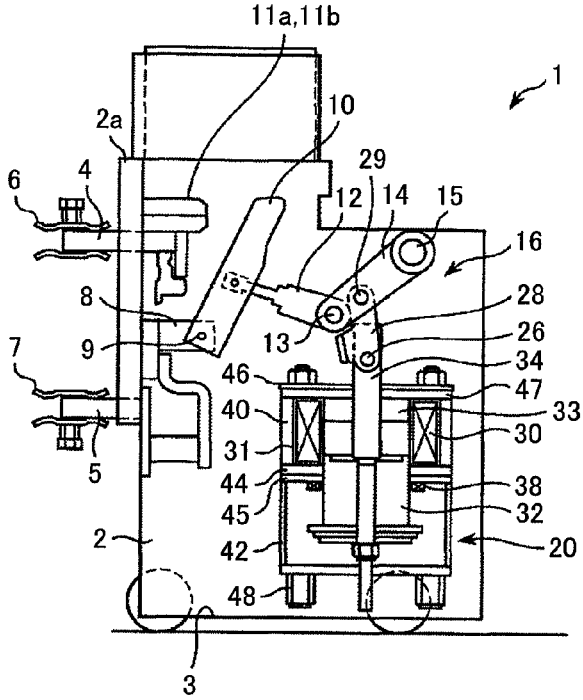
FIG. 1 is a partial cross-sectional side view of an air circuit breaker in a cut-off status according to an embodiment of the present invention.
Figure 2:
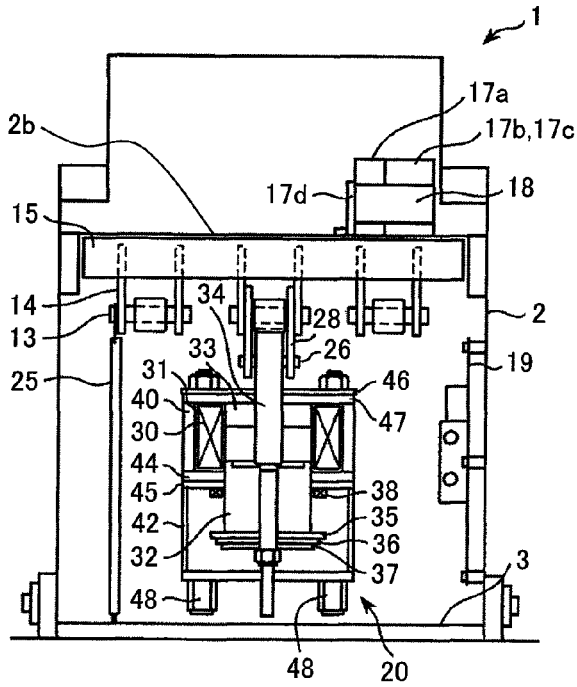
FIG. 2 is a partial cross-sectional front view of the air circuit breaker in the cut-off status according to the embodiment of the present invention shown in FIG. 1.
Figure 3:
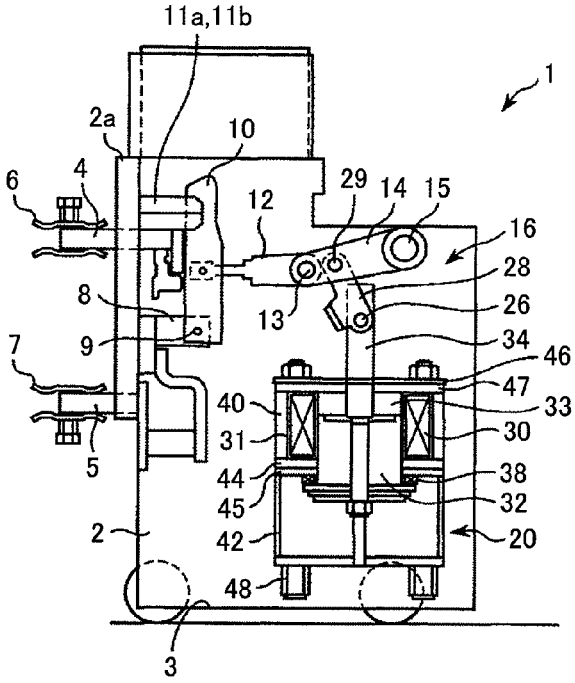
FIG. 3 is a partial cross-sectional side view of the air circuit breaker in an input status according to the embodiment of the present invention.
Figure 4:
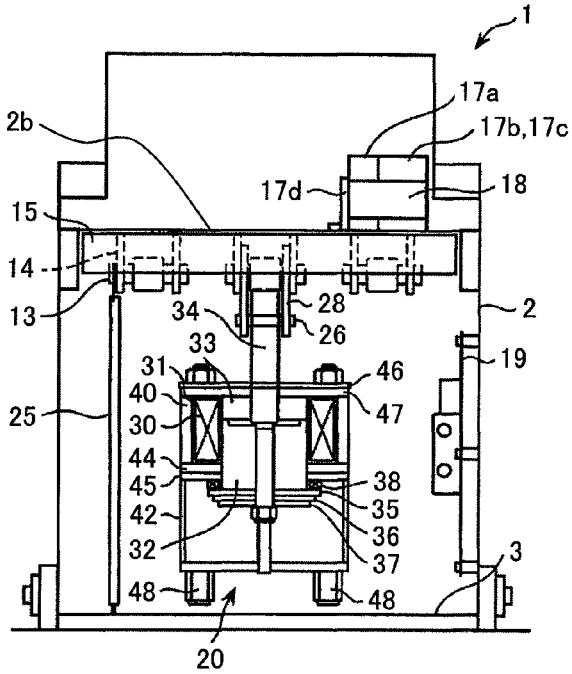
FIG. 4 is a partial cross-sectional front view of the air circuit breaker in the input status according to the embodiment of the present invention shown in FIG. 3.

FIGS. 1 to 4 show the embodiment of the air circuit breaker of the present invention. FIG. 1 is a partial cross-sectional side view of an air circuit breaker in a cut-off status according to an embodiment of the present invention; FIG. 2 is a partial cross-sectional front view of the air circuit breaker in the cut-off status according to the embodiment of the present invention shown in FIG. 1; FIG. 3 is a partial cross-sectional side view of the air circuit breaker in an input status according to the embodiment of the present invention; and FIG. 4 is a partial cross-sectional front view of the air circuit breaker in the input status according to the embodiment of the present invention shown in FIG. 3. Note that in the present embodiment, for the sake of convenience of explanation, the operation unit side of the breaker is the anterior side or the front side, and the breaking unit side of the breaker is the rear side or the back side.

In these figures, an air circuit breaker 1 has a movable carriage 3 having wheels, and a box shaped metal frame 2 placed on the carriage 3. An insulating stand 2*a* is fixed on the back side (the left side in FIGS. 1 and 3) of the metal frame 2.

In the insulating stand 2*a*, a fixed side conductor 4 is fixed to an upper side, and a movable side conductor 5 is fixed to a lower side, respectively through the stand. Disconnection clips 6 and 7 are respectively attached to outer ends of the fixed side conductor 4 and the movable side conductor 5. These disconnection clips 6 and 7 can be inserted/pulled in/from bushings (not shown) on the panel side. As a result, the fixed side conductor 4 and the movable side conductor 5 in the air circuit breaker 1 are respectively connectable/disconnectable to/from a power side bus and a load side bus on the panel side by changing the pull out position of the air circuit breaker 1 with respect to the panel.

A support member 8 is fixed to an inner end of the movable side conductor 5. The support member 8 is provided with a movable element 10 of a single blade-shaped plate type conductive member with one end side (rear anchor side) rotatably supported with a rotation shaft 9.

Stators (fixed elements) 11 (11*a* and 11*b*) electrically connected to the fixed side conductor 4 and respectively arranged to be in/out of contact with the outer side surface on the other end side (tip side) of the movable element 10 are provided on the inner end of the fixed side conductor 4. The movable element 10 is rotated oppositely to the stators 11*a* and 11*b* about the rotation shaft 9 as a supporting point. As a result, the tip end side of the movable element 10 is inserted/pulled in/out oppositely to the stators 11*a* and 11*b*, the input/breaking of the air circuit breaker 1 is realized. In other words, the movable element 10 and the stators 11*a* and 11*b* form a make-and-break unit. Note that FIGS. 1 and 3 show the make-and-break unit only for 1 phase, however, as shown in FIGS. 2 and 4, the make-and-break units having the same structure are arrayed for 3 phases in a frontal view widthwise direction of the air circuit breaker, and the make-and-break units for the central phase (hereinbelow, the second phase) in the frontal view widthwise direction is connected to an electromagnet to be described later.

One end of an insulating rod 12 is connected to an approximate central position on a side surface of the movable element 10. The other end of the insulating rod 12 is connected to one end of a lever 14 via a connecting pin 13. The other end of the lever 14 is pivotally supported with a rotatably supported main rotation shaft 15. Note that the connecting pins 13 are provided in independent three positions for three phases, the main rotation shaft 15 supports through the other ends of the respective levers 14 for three phases, and both ends of the main rotation shaft 15 are rotatably provided on the both sides of the metal frame 2. Further, as shown in FIGS. 2 and 4, the respective levers 14 are formed with a pair of plate members opposite to each other, and the connecting pins 13 are provided over these pairs of plate members respectively.

A so-called servo mechanism 16 includes the insulating rods 12, the connecting pins 13 and the levers 14, respectively independently provided for three phases, the main rotation shaft 15, and a connecting member 28 connecting a shaft 34 of an electromagnet 20 to be described later and the lever 14 for the second phase. The details of the servo mechanism 16 will be described later.

A ceiling cover 2*b* is provided in a front side upper part of the box type metal frame 2. Three capacitors 17*a* to 17*c* are fixed to an upper part of the ceiling cover 2*b*. More particularly, a band (fixing fitting) 18 with its both ends fixed with a support fitting 17*d* provided along an axial direction of the capacitor 17*c* is provided along a radial direction so as to surround the respective capacitors 17*a* to 17*c*. The support fitting 17*d* is fixed to the ceiling cover 2*b* with a bolt.

Cables (not shown) are connected to terminals of the respective capacitors 17*a* to 17*c*, and electric power supplied via the cable is stored in the respective capacitors. The stored electric power is supplied for excitation of a coil of the electromagnet 20 (electromagnetic operation unit) to be described later. Note that in response to an input command or a breaking command to the air circuit breaker 1, a control circuit board 19 to be described later controls a carrying direction of a current to be supplied to the coil of the electromagnet 20 from the respective capacitors 17*a* to 17*c*.

As shown in FIGS. 2 and 4, the control circuit board 19 is fixed to a right side surface of the metal frame 2 with bolts and nuts via a spacer such as a rubber vibration insulator. A control logic unit to receive an input command or a breaking command from a digital relay unit (not shown) or the like and control driving of the electromagnet 20, a charge and discharge circuit to charge/discharge the capacitors 17*a* to 17*c*, and a relay to control an energizing direction of the coil of the electromagnet 20, and the like, are packaged on the control circuit board 19 (not illustrated).

As shown in FIGS. 2 and 4, the electromagnet 20 as an electromagnetic operation unit which drives the movable element 10 is provided in an approximately central position in a front view of the metal frame 2. The electromagnet 20 has a coil (electromagnetic coil) 30, a coil bobbin 31, a movable iron core 32, a fixed iron core 33, a shaft 34, three movable flat plates 35 to 37, a permanent magnet 38, cylindrically formed iron covers 40 and 42, iron support plates iron support plates 44 to 47, fixing rods 48, and the like.

The coil 30 is accommodated in the coil bobbin 31 arranged between the support plates 44 and 47, and the fixing rods 48 are fixed to a bottom plate of the metal frame 2 with bolts and nuts.

The shaft 34 is provided in a central portion of the electromagnet 20 along a vertical direction. In the shaft 34, its lower side is inserted in respective through holes of the movable flat plates 35 to 37 and its upper side is inserted in respective through holes of the support plates 46 and 47, thus slidable in an up-and-down direction. The movable iron core 32 and the movable flat plates 35 to 37 are fixed to an outer peripheral surface of the shaft 34 with nuts, and one end of the connecting member 28 is rotatably connected via a pin 26 to the upper side of the shaft 34.

The three movable flat plates 35 to 37 are attached to the shaft 34. The lowest movable flat plate 37 is downsized so as to appropriately control the mass of the movable part. The permanent magnet 38 fixed to a lower part of the support plate 45 is provided around the movable iron core 32. When the movable iron core 32 is moved upward to be in contact with the fixed iron core 33, the permanent magnet 38 is brought into contact with the periphery of the movable iron core 32.

The fixed iron core 33 is fixed to a lower part of the support plate 47 with e.g. a bolt. To reduce magnetic resistance, the movable iron core 32 and the fixed iron core 33 may be formed using pure iron, silicon steel or the like.

The other end of the connecting member 28, with its one end connected to the upper side of the shaft 34, is connected to the lever 14 for the second phase in the vicinity of the connecting pin 13 with a pin 29. Further, as shown in FIGS. 2 and 4, one end of a breaking spring 25 is attached to an outer end in the axial direction of the connecting pin 13 for the left side phase (referred to as a "first phase" hereinbelow) in the frontal view widthwise direction, and the other end of the breaking spring 25 is attached to the bottom plate of the metal frame 2. When the movable element 10 is inputted and the connecting pin 13 is pulled upward, the breaking spring 25 is extended and energy-stored (see FIG. 4).

Next, the operation of the one embodiment of the above-described air circuit breaker according to the present invention will be described. In the cut-off status shown in FIGS. 1 and 2, when an input command is inputted into the control circuit board 19, based on a signal from the control circuit board 19, the coil (electromagnetic coil) 30 of the electromagnet 20 is energized, and a magnetic field is formed around the coil 30 through a passage connecting the movable iron core 32, the fixed iron core 33, the support plates 47 and 46, the cover 42, the support plates 44 and 45, and the movable iron core 32. An upward attraction force acts on the upper side surface of the movable iron core 32, then the movable iron core 32 is moved to the fixed iron core 33 side, and the movable iron core 32 is attracted to the fixed iron core 33.

At this time, as the orientation of the magnetic field formed with the permanent magnet 38 is the same as the orientation of a magnetic field caused in accordance with the excitation of the coil 30, the movable iron core 32 is moved to the fixed iron core 33 side in a status where the attraction force is enhanced. Note that in the support plates 46, 47, 44 and 45, the coil side i.e. the support plates 47 and 44 are thick so as to ensure the strength against shock to be caused and the distribution area of magnetic flux by the coil 30.

When the input operation with the electromagnet 20 is performed, as shown in FIGS. 3 and 4, the shaft 34 is moved upward against an elastic force of the breaking spring 25, and a driving force by the electromagnetic force caused from the electromagnet 20 is transmitted to the connecting member 28. The driving force is transmitted via the connecting member 28 and the pin 29 to the lever 14 for the second phase, to rotate the lever 14 for the second phase clockwise with the main rotation shaft 15 as a supporting point. As a result, the levers 14 for other phases with other ends pivotally supported with the main rotation shaft 15 are similarly rotated clockwise.

In this arrangement, the respective connecting pins 13 for the three phases are moved upward, and the respective insulating rods 12 for the three phases with their one end connected to the respective connecting pins 13 are moved upward. As the other end of the insulating rod 12 is connected to the movable element 10 with its rear anchor pivotally supported with the rotation shaft 9, the respective movable elements 10 for the three phases are rotated counterclockwise about the rotation shaft 9 in accordance with the upward movement of the one end side of the insulating rods 12. As a result, the ends of the respective movable elements 10 for the three phases are inserted oppositely to the respective stators 11*a* and 11*b* for the three phases, thus the input operation of the air circuit breaker 1 is performed.

As a result, a line connecting connection points of the main rotation shaft 15, the lever 14, the connecting pin 13, the insulating rod 12 and the movable element 10 is an approximate straight line, the connecting pin 13 is provided in an upper position, and the breaking spring 25 is always extended and energy-stored during the input operation of the air circuit breaker 1.

Next, when a breaking command (opening command) is inputted into the control circuit board 19, a signal according to the breaking command is outputted from the control circuit board 19. As a result, a current in an opposite direction to that upon the input flows through the coil 30, and a magnetic field in an opposite orientation to that upon the input operation is formed around the coil 30. As the magnetic flux caused from the coil 30 and the magnetic flux caused from the permanent magnet 38 cancel each other, the attraction force on the axial direction end surface (upper surface) is weaker than the elastic force caused from the breaking spring 25, the movable iron core 32 is moved away from the fixed iron core 33 and is moved downward.

When the shaft 34 is moved downward in accordance with the movement of the movable iron core 32, the lever 14 for the second phase is rotated counterclockwise with the main rotation shaft 15 as a supporting point via the connecting member 28 and the pin 29, as shown in FIGS. 1 and 2. As a result, the levers 14 for the other phases with their other end pivotally supported with the main rotation shaft 15 are similarly rotated counterclockwise.

In this arrangement, the respective connecting pins 13 for the three phases are moved downward, and the respective insulating rods 12 for the three phases with their one end connected to the respective connecting pins 13 are moved downward. As the other end of the insulating rod 12 is connected to the movable element 10 with its rear anchor pivotally supported with the rotation shaft 9, the movable element 10 is rotated clockwise about the rotation shaft 9 as a center in accordance with the downward movement of the one end side of the insulating rod 12. As a result, the ends of the respective movable elements for the three phases are pulled out oppositely to the respective stators 11*a* and 11*b* for the three phases, thus the breaking of the air circuit breaker 1 is performed.

As a result, a line connecting the main rotation shaft to the lever 14, and a line connecting the connecting points of the insulating rod 12 and the movable element 10 are formed in a V shape at the connecting pin 13. The connecting pin 13 is provided in a lower position, and the extension of the breaking spring 25 is released.

According to the one embodiment of the above-described air circuit breaker according to the present invention, as the operation mechanism for the air circuit breaker 1 is formed by combining the simple servo mechanism 16 and the electromagnet operation unit 20 with the permanent magnet 38, the electromagnetic operation unit 20 can be downsized, and a sufficient breaking speed can be ensured. As a result, it is possible to provide a further-downsized and lower-price air circuit breaker 1.

Further, according to the one embodiment of the above-described air circuit breaker according to the present invention, after the input operation of the air circuit breaker 1, a holding power to hold the input position of the movable element 10 is caused by the permanent magnet 38 of the electromagnet 20. However, since the servo mechanism is employed, the holding force of the permanent magnet 38 may be a force merely corresponding to the combination of the spring force of the breaking spring 25 and the weight of the movable iron core 32 of the electromagnet 20 and the like. Accordingly, it is possible to downsize the permanent magnet 38 and provide a price-reduced air circuit breaker 1.

Further, since the mechanical latch mechanism to hold the input position of the movable element in the conventional air circuit breaker can be omitted, it is possible to reduce the number of parts forming these mechanisms and provide a price-reduced air circuit breaker 1.

Further, according to the one embodiment of the air circuit breaker according to the present invention, the breaking operation of the air circuit breaker 1 is performed by moving the movable iron core 32 of the electromagnet 20 downward then pushing the servomechanism 16 downward and pulling the movable element 10 from the stator 11. As the weight of the movable iron core 32 of the electromagnet 20 acts in the operational direction and added to the breaking spring force, a sufficient breaking speed of the air circuit breaker 1 can be ensured. As a result, it is possible to provide an air circuit breaker 1 in which the breaking speed is ensured even with a small electromagnet.

Further, according to the one embodiment of the above-described air circuit breaker according to the present invention, as the main rotation shaft 15 connecting the servo mechanisms 16 for the three phases is provided, and connected with the shaft 34 of the electromagnet 20 in the central part for the second phase, the operation of the air circuit breaker 1 is stabilized, and the number of parts can be reduced. As a result, it is possible to provide a further-downsized and price-reduced air circuit breaker 1.

What is claimed is:

1. An air circuit breaker comprising:

a make-and-break unit having a stator and a blade-shaped movable element disposed oppositely to the stator and rotatably supported with a support shaft;

an electromagnetic operation unit having a fixed iron core provided in an upper position, a movable iron core provided in a position oppositely to the fixed iron core and provided below the fixed iron core, a coil to connect/disconnect the fixed iron core and the movable iron core with an electromagnetic force, and a permanent magnet;

a capacitor that energy-stores electric power to excite the coil of the electromagnetic operation unit;

a control circuit board that controls a carrying direction of a current supplied from the capacitor to the coil in response to an input command or a breaking command to the make-and-break unit;

a servo mechanism connected to the movable iron core in the electromagnetic operation unit and provided above the electromagnetic operation unit so as to transmit a driving force by the electromagnetic force of the electromagnetic operation unit to the make-and-break unit; and a breaking spring with one end attached to a connecting pin of the servo mechanism and the other end attached to a bottom plate of the air circuit breaker, wherein the breaking spring is extended and energy-stored when the movable element in the make-and-break unit is inputted and the connecting pin is pulled upward.

2. The air circuit breaker according to claim 1, wherein the permanent magnet of the electromagnetic operation unit is provided under a support plate of the coil so as to be in contact with a lower part of the movable iron core when the movable iron core is brought into contact with the fixed iron core.

3. The air circuit breaker according to claim 1, wherein the movable elements are independently formed for three phases, and the servo mechanism has insulating rods connected to the respective movable elements, levers with their one ends connected via connecting pins to the respective insulating rods, a rotation shaft that pivotally supports through the other ends of the respective levers, and a connecting member connecting a movable iron core of the electromagnetic operation unit to at least one of the levers.

4. An air circuit breaker comprising:

a make-and-break unit having a stator and a blade-shaped movable element disposed oppositely to the stator and rotatably supported with a support shaft;

an electromagnetic operation unit having a fixed iron core provided in an upper position, a movable iron core provided in a lower position oppositely to the fixed iron core, a coil to connect/disconnect the fixed iron core and the movable iron core with an electromagnetic force, and a permanent magnet;

a capacitor that energy-stores electric power to excite the coil of the electromagnetic operation unit;

a control circuit board that controls a carrying direction of a current supplied from the capacitor to the coil in response to an input command or a breaking command to the make-and-break unit; and a servo mechanism connected to the movable iron core in the electromagnetic operation unit and provided above the electromagnetic operation unit so as to transmit a driving force by the electromagnetic force of the electromagnetic operation unit to the make-and-break unit, wherein the movable elements are independently formed for three phases, and the servo mechanism has insulating rods connected to the respective movable elements, levers with their one ends connected via connecting pins to the respective insulating rods, a rotation shaft that pivotally supports through the other ends of the respective levers, and a connecting member connecting a movable iron core of the electromagnetic operation unit to at least one of the levers, further comprising a breaking spring with one end attached to the connecting pin of the servo mechanism and the other end attached to a bottom plate of the air circuit breaker, wherein the breaking spring is extended and energy-stored when the movable element in the make-and-break unit is inputted and the connecting pin is pulled upward.

5. The air circuit breaker according to claim 1, wherein the electromagnetic operation unit is provided approximately at the center in a frontal view widthwise direction of the air circuit breaker.

6. An air circuit breaking comprising:

a make-and-break unit having a stator and a blade-shaped movable element disposed oppositely to the stator and rotatably supported with a support shaft;

an electromagnetic operation unit having a fixed iron core, a movable iron core provided in a lower position oppositely to the fixed iron core so that the movable iron core is brought upward in response to an input command to the make-and-break unit and the movable iron core is brought downward in response to a breaking command to the make-and-break unit, a coil to produce an electromagnetic force, and a permanent magnet to be in contact with the movable iron core when the movable iron core is brought into contact with the fixed iron core;

a capacitor to store electric power to excite the coil of the electromagnetic operation unit;

a control circuit board that controls a carrying direction of a current supplied from the capacitor to the coil in response to the input command or the breaking command to the make-and-break unit;

a servo mechanism provided above the electromagnetic operation unit and connected to the movable iron core and the blade-shaped movable element; and a breaking spring with one end attached to a connecting pin of the servo mechanism and the other end attached to a bottom plate of the air circuit breaker, wherein the breaking spring is extended and energy-stored when the movable element in the make-and-break unit is inputted and the connecting pin is pulled upward.

* * * * *